US009457457B2

(12) United States Patent
Chiang

(10) Patent No.: US 9,457,457 B2
(45) Date of Patent: Oct. 4, 2016

(54) RATCHET WRENCH

(71) Applicant: WILLIAM TOOLS CO., LTD., Taichung (TW)

(72) Inventor: Shui-Lai Chiang, Taichung (TW)

(73) Assignee: WILLIAM TOOLS CO., LTD., Taichung (TW)

( * ) Notice: Subject to any disclaimer, the term of this patent is extended or adjusted under 35 U.S.C. 154(b) by 249 days.

(21) Appl. No.: 14/269,400

(22) Filed: May 5, 2014

(65) Prior Publication Data

US 2015/0314426 A1 Nov. 5, 2015

(51) Int. Cl.

| | |
|---|---|
| ***B25B 13/46*** | (2006.01) |
| ***B25B 13/48*** | (2006.01) |
| ***B25B 17/02*** | (2006.01) |

(52) U.S. Cl.

CPC ..... *B25B 13/465* (2013.01); *B25B 13/467* (2013.01); *B25B 13/481* (2013.01); *B25B 17/02* (2013.01)

(58) Field of Classification Search

CPC ... B25B 17/00; B25B 13/467; B25B 13/465; B25B 13/481; B25B 23/0035; B25B 15/04

USPC ..... 81/58.1, 57.29, 32

See application file for complete search history.

(56) References Cited

U.S. PATENT DOCUMENTS

| | | | | |
|---|---|---|---|---|
| 2,206,802 | A * | 7/1940 | Brenning | B25B 13/467 74/435 |
| 4,406,184 | A * | 9/1983 | Cockman, Jr. | B25B 17/00 81/57.29 |
| 4,545,267 | A * | 10/1985 | Shumway | B25B 13/467 81/57.29 |
| 6,070,499 | A * | 6/2000 | Wisbey | B25B 13/467 81/57.29 |
| 7,267,033 | B1 * | 9/2007 | Lai | B25B 13/465 81/57.29 |

FOREIGN PATENT DOCUMENTS

| | | |
|---|---|---|
| TW | M311540 | 5/2007 |

* cited by examiner

*Primary Examiner* — Hadi Shakeri

(74) *Attorney, Agent, or Firm* — Ming Chow; Sinorica, LLC

(57) ABSTRACT

A ratchet wrench includes a wrench member, a driving shaft, a rotary member, two first paws, a grip, and a second paw. The wrench member has a ratchet hole, an axial hole, and first inner teeth on a sidewall of the ratchet hole. The driving shaft is received in the axial hole of the wrench member. The rotary member is received in the ratchet hole of the wrench member, and has annular teeth to engage a gear of the driving shaft. The first paws are provided on the barrel, and each has first outer teeth to engage the first inner teeth of the wrench member. The grip is pivotally connected to the wrench member, and has second inner teeth. The second paw is provided on the driving shaft, and has second outer teeth to engage the second inner teeth of the tube.

5 Claims, 4 Drawing Sheets

RATCHET WRENCH

BACKGROUND OF THE INVENTION

1. Field of the Invention

The present invention relates generally to a hand tool, and more particularly to a ratchet wrench.

2. Description of the Related Art

Ratchet wrench is a hand tool which allows user to tighten or loosen fasteners, such as nuts and bolts, quickly without having to engage and disengage the fastener repeatedly. A conventional ratchet wrench usually is provided with a ratcheting mechanism. While one turns the wrench in one direction, the ratcheting mechanism transmits the force to drive the fastener, which engages the wrench, and while the wrench is tuned in the opposite direction, the ratchet does not turn the fastener which allows the wrench to be re-positioned for another turn. The conventional ratcheting mechanism usually has a paw and a gear, and there is a gap between the paw and the gear for the reverse turning. However, this gap leads an invalid distance in the beginning while the wrench is turned to drive the fastener. In addition, there is a gap between a rod of the wrench and a socket which engages the rod also, and this gap increases the invalid distance. The invalid distance is disadvantageous for the ratchet wrench to drive the fastener in a narrow space. An improved ratchet wrench provides a gear with more teeth to reduce the gap between the gear and the paw. However, it is much difficult to manufacture the gear with more teeth, and furthermore, the teeth will be thinner that can't take a larger driving force.

Taiwan Utility Module M311540 disclosed a ratchet wrench to eliminate the gap problem. However, there are too many elements in the wrench to fix the problem, so the cost to manufacture the wrench is high, and the process of manufacture is complex and difficult.

SUMMARY OF THE INVENTION

The primary objective of the present invention is to provide a ratchet wrench, which may eliminate the gap in the wrench with a simple structure.

According to the objective of the present invention, the present invention provides a ratchet wrench, including a wrench member, a driving shaft, a rotary member, at least a first paw, a grip, and at least a second paw. The wrench member has a ratchet hole, an axial hole, and first inner teeth on a sidewall of the ratchet hole, wherein the axial hole has an end communicated with the ratchet hole. The driving shaft is received in the axial hole of the wrench member for rotation, and has a gear and a driven portion at opposite ends thereof. The rotary member is received in the ratchet hole of the wrench member for rotation, and has a barrel and a rim on an end of the barrel, wherein the barrel has a connecting bore to receive a transmission rod; the rim has annular teeth on a side facing the barrel to engage the gear of the driving shaft. The first paw is provided on the barrel, and has first outer teeth to engage the first inner teeth of the wrench member. The grip is pivotally connected to the wrench member, and has a tube received in the grip, wherein the tube has second inner teeth on an inner side thereof. The second paw is provided on the driving shaft, and has second outer teeth to engage the second inner teeth of the tube.

In an embodiment, a sliding slot is provided on a sidewall of the connecting bore of the rotary member or on the transmission rod; the sliding slot has two walls at opposite ends; a pin is inserted into the transmission rod or the rotary member, and engages the sliding slot; the pin is movable between the walls of the sliding slot to restrict the transmission rod to move in a limited distance.

In an embodiment, the wrench member has a head and a beam; the head has the ratchet hole, and the beam has the axial hole; the driving shaft is provided with a trench adjacent to the gear; the beam has a through hole, and a pin is inserted into the through hole and engages the trench.

In an embodiment, the rotary member is provided with at least a slot on the barrel to receive the first paw.

In an embodiment, the driving shaft is provided with at least a recess on the driven portion to receive the second paw.

In an embodiment, the ratchet wrench further includes a first biasing member for urging the first paw to engage the first outer teeth of the first paw with the first inner teeth of the wrench member.

In an embodiment, the ratchet wrench further includes a second biasing member for urging the second paw to engage the second outer teeth of the second paw with the second inner teeth of the tube.

Therefore, user may turn the grip to eliminate a gap between the first paw and the first inner teeth to drive the fastener in a narrow space. Furthermore, there are fewer elements in the ratchet wrench than the prior art, it could reduce the cost of manufacture.

DETAILED DESCRIPTION OF THE INVENTION

Figure 1:
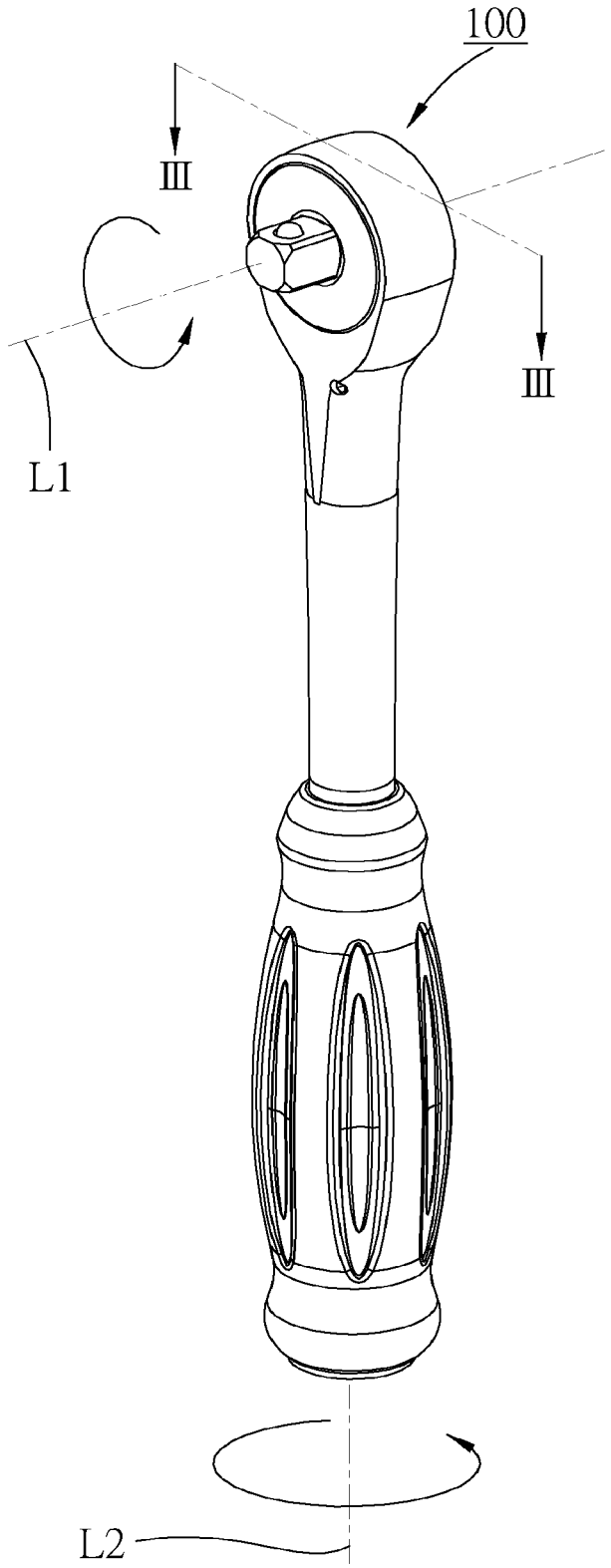
FIG. 1 is a perspective view of a preferred embodiment of the present invention.

As shown in FIG. 1 to FIG. 6, a ratchet wrench 100 of the preferred embodiment of the present invention includes a wrench member 10, a driving shaft 20, a rotary member 30, two first paws 40, a second paw 50, and a grip 60.

The wrench member 10 has a head 12 and a beam 14. The head 12 has a ratchet hole 122, a first cavity 122*a* at an end of the ratchet hole 122, and a second cavity 122*b* at the other end of the ratchet hole 122. Diameters of the first cavity 122*a* and the second cavity 122*b* are larger than that of the ratchet hole 122. The head 12 is provided with first inner teeth 16 on a sidewall of the ratchet hole 122. The beam 14 has an end connected to the head 12, and has an axial hole 142 through opposite ends of the beam 14. An end of the axial hole 142 which connects to the first cavity 122*a* is defined as a second opening end 142*b*, and the other end thereof on a distal end of the beam 14 is defined as a first opening end 142*a*. The ratchet hole 122 has a first axial line L1 at a center thereof, and the axial hole 142 has a second axial line L2 at a center thereof, wherein the first axial line L1 and the second axial line L2 are orthogonal.

Figure 2:
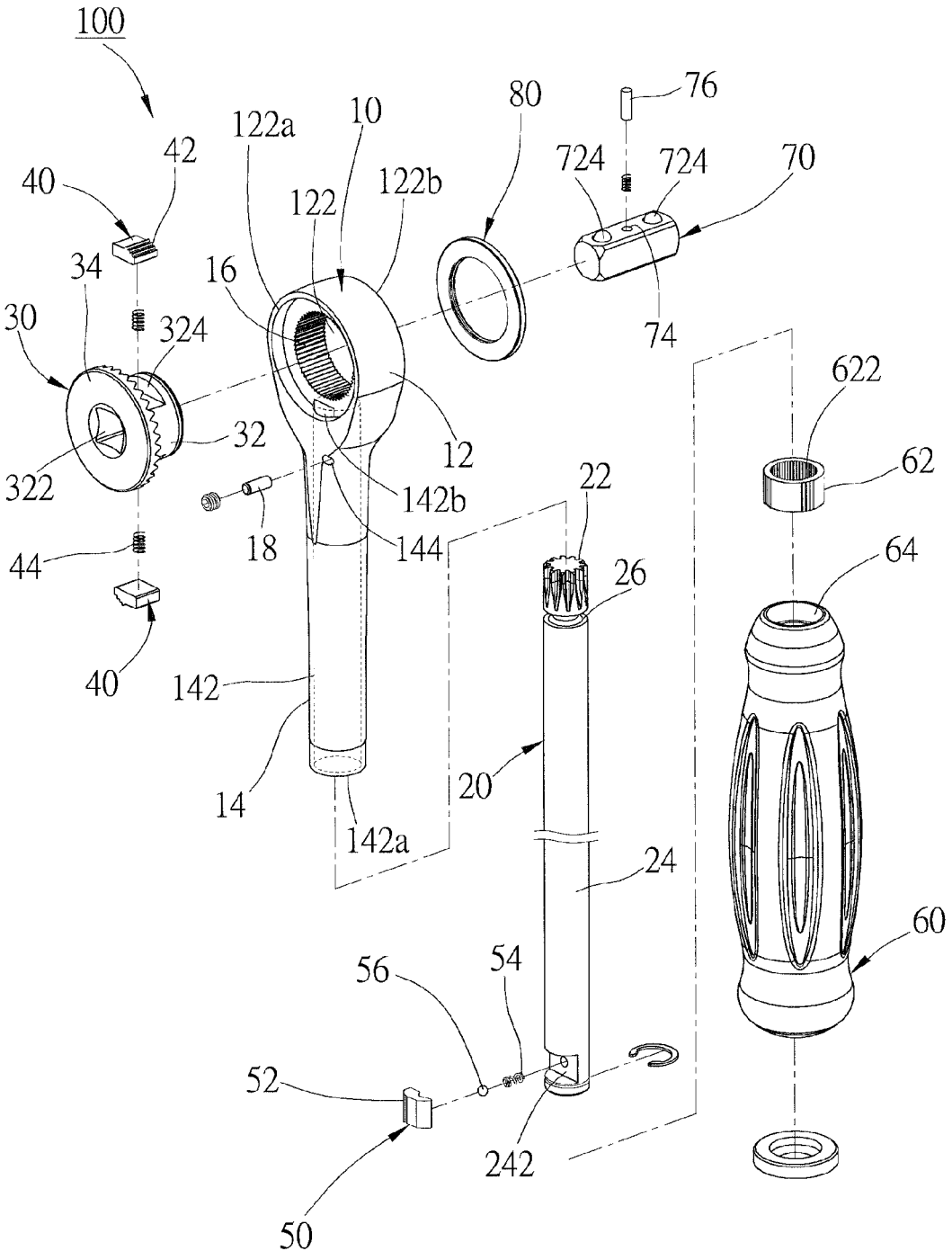
FIG. 2 is an exploded view of the preferred embodiment of the present invention.
Figure 4:
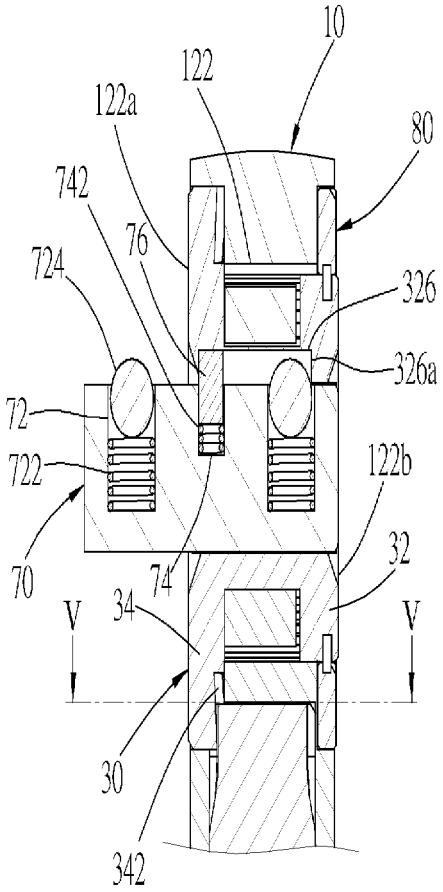
FIG. 4 is a sectional view along the IV-IV line in FIG. 3.
Figure 3:
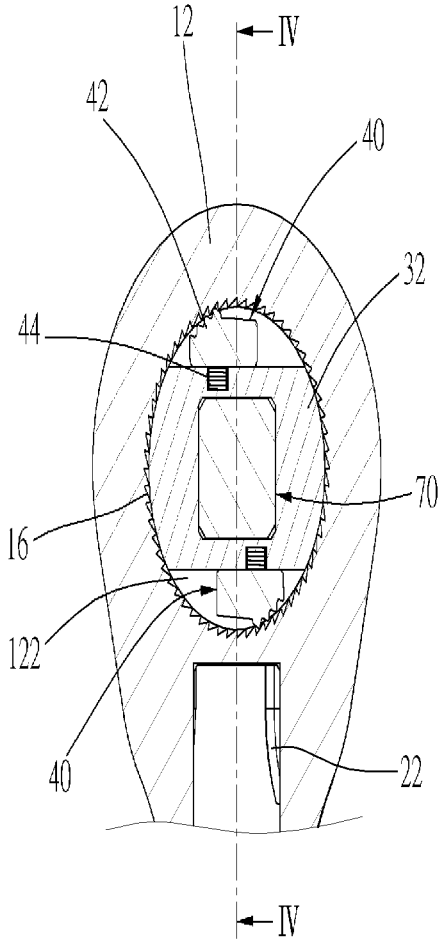
FIG. 3 is a sectional view along the III-III line in FIG. 1.

As shown in FIG. 2 and FIG. 4, the rotary member 30 is received in the ratchet hole 122 for free rotation along the first axial line L1. The rotary member 30 has a barrel 32 and a rim 34 at an end of the barrel 32, and a diameter of the rim 34 is greater than that of the barrel 32. The barrel 32 has a connecting bore 322 to receive a transmission rod 70. As shown in FIG. 2 and FIG. 3, the barrel 32 is provided with two slots 324 on opposite sides of a circumference thereof, and the first paws 40 are received in the slots 324 respectively. Each first paw 40 has first outer teeth 42. As shown in FIG. 3, two first biasing members 44 are received in the lots 324 to urge the first paws 40 respectively. The first biasing members 44 urge the paws 40 respectively to engage the first outer teeth 42 of the first paws 40 with the first inner teeth 16 of the wrench member 10.

As shown in FIG. 4, the rim 34 has annular teeth 342 at a side facing the barrel 32. The barrel 32 is received in the ratchet hole 122 of the wrench member 10, the rim 34 is received in the first cavity 122*a*, and a disk 80 is received in the second cavity 122*b* to install the rotary member 32 in the head 12 of the wrench member 10.

The barrel 32 is provided with a sliding slot 326 on a sidewall of the connecting bore 322, and the sliding slot 326 has two walls 326*a* at opposite ends thereof. The transmission rod 70 includes two positioning slots 72 and a positioning bore 74, and the positioning bore 74 is between the positioning slots 72. A spring 742 and a pin 76 are received in the positioning bore 74 in sequence. The pin 76 is urged by the spring 742 to be received in the sliding slot 326 normally, therefore the transmission rod 70 is restricted to move in a limited distance within the sliding slot 326, and furthermore the transmission rod 70 is unable to rotate related to the barrel 32. As a result, the transmission rod 70 could be moved to extrude out of the head 12 of the wrench member 10 via opposite sides. Each positioning slot 72 is installed with a spring 722 and a ball 724 in sequence. As shown in FIG. 4, the right ball 724 enters the sliding slot 326 while the transmission rod 70 is moved to the left to hold the transmission rod 70 at that position. On the contrary, the left ball 724 enters the sliding slot 326 while the transmission rod 70 is moved to the right to hold the transmission rod 70. The transmission rod 70 engages a socket (not shown), which connects to a fastener (not shown).

Figure 5:
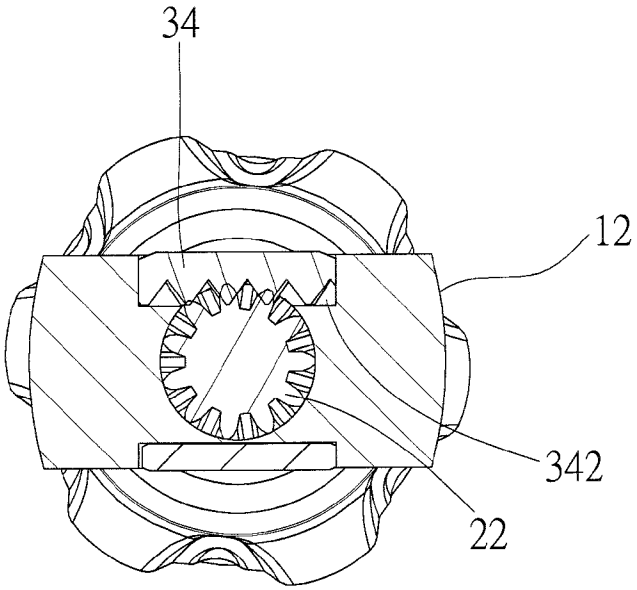
FIG. 5 is a sectional view along the V-V line in FIG. 4.

As shown in FIG. 2 and FIG. 5, the driving shaft 20 is provide with a gear 22 and a driven portion 24 at opposite ends thereof. The driving shaft 20 is inserted into the axial hole 142 of the wrench member 10. The gear 22 extends out of the axial hole 142 via the second opening end 142*b* to engage the teeth 342 of the rotary member 30. The driving shaft 20 further is provided with an annular trench 26 under the gear 22, and the beam 14 is provided with a through hole 144. A pin 18 is inserted into the through hole 144, and engaged with the trench 26 to fix the driving shaft 20 to the beam 14, but allow the driving shaft 20 to rotate related to the beam 14.

Figure 6:
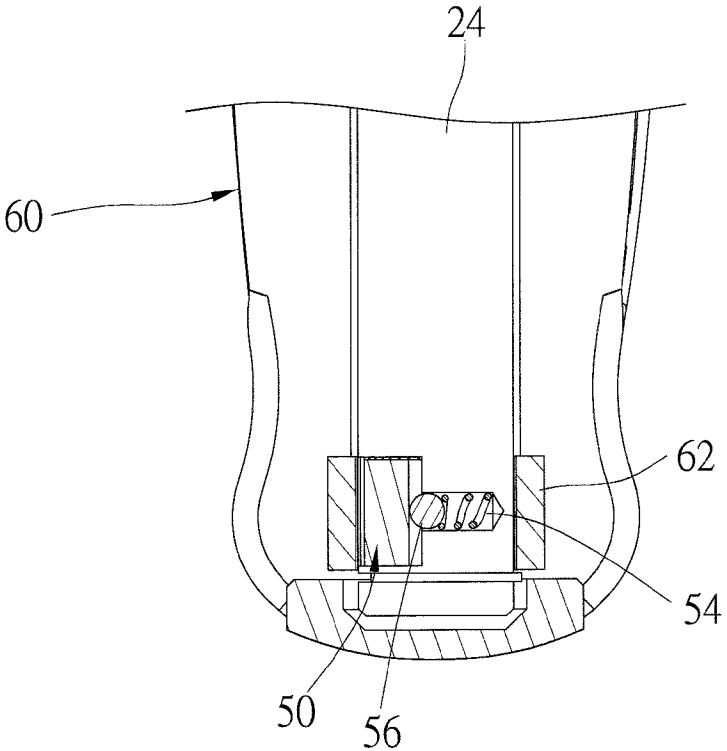
FIG. 6 is a sectional view in a part of the preferred embodiment of the present invention, showing the driving shaft and the grip.

As shown in FIG. 2 and FIG. 6, the grip 16 has an axial hole 64, in which a tube 62 is fixed. The tube 62 is provided with second inner teeth 622 on an inner side. The driving shaft 20 is provided with a recess 242 on the driven portion 24, in which a second biasing member 54 and the second paw 50 are received. The second paw 50 has second outer teeth 52. The distal end of the driving shaft 20 is inserted into the grip 16, and the driven portion 24 is received in the tube 62 to engage the second paw 50 with the second inner teeth 622.

The ratchet wrench 100 of the present invention is able to drive a fastener in a narrow space. As shown in FIG. 1 and FIG. 2, in order to eliminate a gap between the first paw 40 and the first outer teeth 42, the grip 60 is turned along the second axial line L2 counterclockwise to drive the second paw 50 and the driving shaft 20, and at the same time, the first paw 40 is moved because of the engagement of the gear 22 and the teeth 342 of the rotary member 30. As a result, the first outer teeth 42 of the first paw 40 tightly touch the first inner teeth 16 of the wrench member 10 to eliminate the gap therebetween. Therefore, the ratchet wrench 100 of the present invention could drive a fastener in a narrow space by turning the grip 60 along the second axial line L2. While the grip 60 is turned along the second axial line L2, the ratchet wrench 100 of the present invention provides a small torque to drive the fastener. However, because the first outer teeth 42 of the first paw 40 tightly touch the first inner teeth 16 of the wrench member 10, it eliminates the gap therebetween at the same time, so the ratchet wrench 100 could be turned along the first axial line L1 to drive the fastener with a large torque.

It is noted that the user may drive a fastener in a narrow space by turning the grip 60 along the second axial line L2 (small torque output), or by turning the grip 60 along the second axial line L2 (eliminate the gap), and then turning the wrench member 10 along the first axial line L1 (large torque output).

In addition, while the grip 60 is turned along the second axial line L2, it may eliminate the gap between the first outer teeth 42 of the first paw 40 and the first inner teeth 16 of the wrench member 10, and at the same time, a gap between the transmission rod 70 and the socket (not shown), which is connected to the transmission rod 70, is eliminated as well.

The description above is a few preferred embodiments of the present invention and the equivalence of the present invention is still in the scope of claim construction of the present invention.

The invention claimed is:

1. A ratchet wrench, comprising:

a wrench member having a ratchet hole, an axial hole, and first inner teeth on a sidewall of the ratchet hole, wherein the axial hole has an end communicated with the ratchet hole;

a driving shaft received in the axial hole of the wrench member for rotation, and having a gear and a driven portion at opposite ends thereof;

a rotary member received in the ratchet hole of the wrench member for rotation, and having a barrel and a rim on an end of the barrel, wherein the barrel has a connecting bore to receive a transmission rod, the rim has annular teeth on a side facing the barrel to engage the gear of the driving shaft;

at least a first paw provided on the barrel, and having first outer teeth to engage the first inner teeth of the wrench member;

a grip having an axial hole for receiving the driven portion of the driving shaft;

a tube fixedly received within the axial hole of the grip, wherein the tube has second inner teeth on an inner side thereof;

the driving shaft is provided with a recess on the driven portion in alignment with the tube;

a second paw provided on the driving shaft within the recess, and having second outer teeth to engage the second inner teeth of the tube; and a biasing member provided on the driving shaft between a bottom wall of the recess and the second paw for urging the second paw to engage the second outer teeth of the second paw with the second inner teeth of the tube.

2. The ratchet wrench as defined in claim 1, wherein a sliding slot is provided on a sidewall of the connecting bore of the rotary member or on the transmission rod; the sliding slot has two walls at opposite ends; a pin is inserted into the transmission rod or the rotary member, and engages the sliding slot; the pin is movable between the walls of the sliding slot to restrict the transmission rod to move in a limited distance.

3. The ratchet wrench as defined in claim 1, wherein the wrench member has a head and a beam; the head has the ratchet hole, and the beam has the axial hole; the driving shaft is provided with a trench adjacent to the gear; the beam has a through hole, and a pin is inserted into the through hole and engages the trench.

4. The ratchet wrench as defined in claim 1, wherein the rotary member is provided with at least a slot on the barrel to receive the at least a first paw.

5. The ratchet wrench as defined in claim 1, further comprising a first biasing member for urging the at least a first paw to engage the first outer teeth of the at least a first paw with the first inner teeth of the wrench member.

* * * * *